US005726396A

United States Patent [19]

Erath

[11] Patent Number: 5,726,396

[45] Date of Patent: Mar. 10, 1998

[54] FOLDED ACOUSTICAL HORN

[76] Inventor: Louis W. Erath, 209 N. State St., Abbeville, La. 70510

[21] Appl. No.: 771,433

[22] Filed: Dec. 20, 1996

Related U.S. Application Data

[63] Continuation of Ser. No. 348,726, Dec. 2, 1994, abandoned.

[51] Int. Cl.[6] ..... H05K 5/00

[52] U.S. Cl. ..... 181/152; 181/177; 116/140

[58] Field of Search ..... 181/152, 153, 181/155, 159, 177, 179, 183, 185–189, 192, 194; 381/156, 160; 116/137 R, 140

[56] References Cited

U.S. PATENT DOCUMENTS

| | | | |
|---|---|---|---|
| 3,432,002 | 3/1969 | Cohen | 181/152 |
| 4,378,471 | 3/1983 | Shintaku | 181/177 X |
| 4,689,609 | 8/1987 | Ko et al. | 381/156 X |
| 4,908,601 | 3/1990 | Howze | 181/152 X |
| 5,298,690 | 3/1994 | Klein | 181/152 |

OTHER PUBLICATIONS

FA–232073 Half–Mile Fog Signal Operating Manual of Automatic Power, Inc., pp.2–4 and three pages of drawings dated Aug. 16, 1968.

The "Stacked Array" SA–3C—Fog Signal System Operating Manual of Automatic Power, Inc., p. 1 and two pages of drawings dated Jun. 22, 1964 and Sep. 23, 1969, respectively.

DA–2 and DA–8 Fog Horn Operating Manual of Automatic Power, Inc., pp. 4, 8 and 9, and two pages of drawings dated May 18, 1982 and Jun. 18, 1982, respectively.

SA–850/1A Half–Mile Signal one undated page of promotional material of Automatic Power, Inc.

SA–850/3 Sound Signal one undated page of promotional material of Automatic Power, Inc.

SA–850/4A Battery Operated Two–Mile Sound Signal one undated page of promotional material of Automatic Power, Inc.

AB–26 Audiobeam® 1/2–Mile Fog Signal two pages of promotional material of Tideland Signal Corporation, dated 1984.

AB–560 Audiobeam® 2–Mile Fog Signal four pages of promotional material of Tideland Signal Corporation, dated 1986.

AB–860 Audiobeam® 2–Mile Fog Signal four pages of promotional material of Tideland Signal Corporation, dated 1989.

Finch, R.D. & Higgins, P.W., Optimizing the Monotone Performance of Electrodynamic Drivers Using Tubular Couplers, Journal of the Acoustical Society of America, vol. 60, No. 4, Oct., 1976, pp. 937–943.

Olson, H.F., Acoustical Engineering, D. Van Norstrand Company, Inc., Princeton, NJ, 1957, pp. v–xix, 47–55, 66–70, 100–123, 163–167 and 240–242.

*Primary Examiner*—Khanh Dang
*Attorney, Agent, or Firm*—Robert N. Montgomery

[57] ABSTRACT

A folded acoustical horn is disclosed, having an acoustical transmission path that is generally arcuate about an axis, including a pair of arcuate mouths that are longitudinally spaced apart a selected distance and directed radially outwardly. A horn tuner is operable to selectively adjust the acoustical path to match selected sound frequencies.

15 Claims, 4 Drawing Sheets

FIG.1
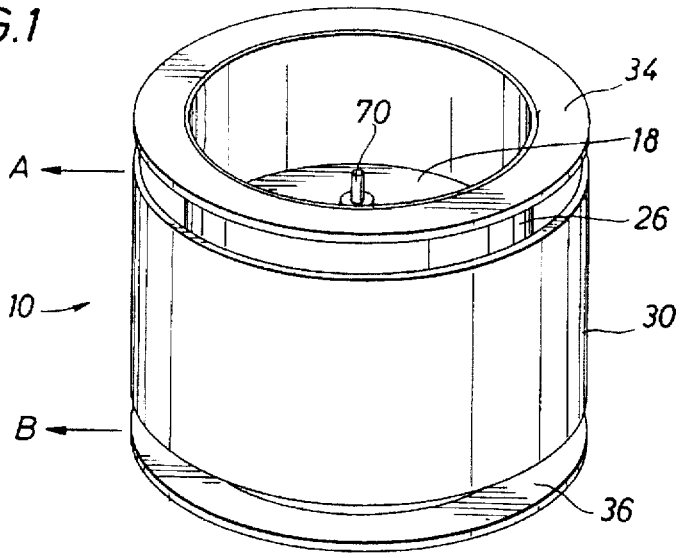
FIG. 2
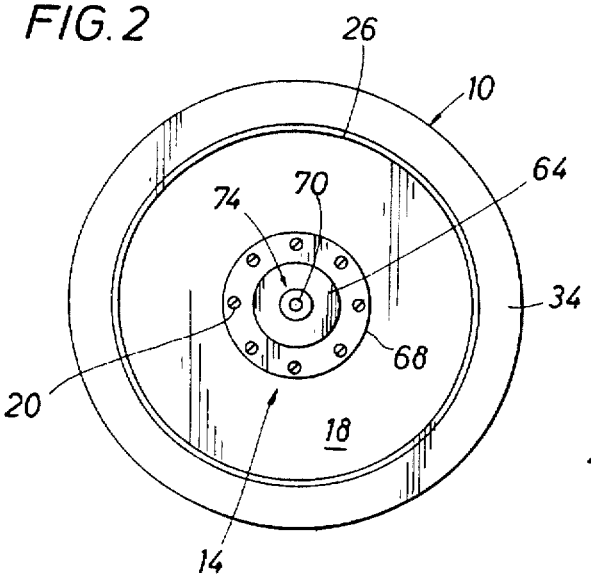
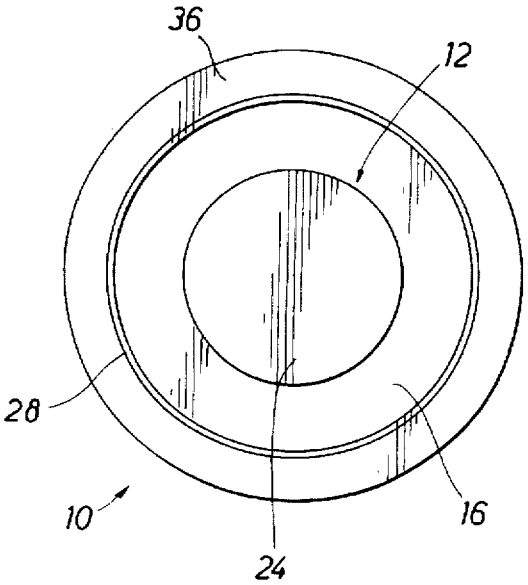
FIG. 3
FIG.5
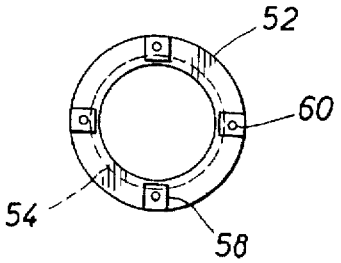

FOLDED ACOUSTICAL HORN

This is a continuation of application Ser. No. 08/348,726 filed Dec. 2, 1994, now abandoned.

BACKGROUND OF THE INVENTION

1. Field of the Invention

The present invention pertains to apparatus for amplifying and directing sound. More particularly, the present invention relates to acoustical horns included in loudspeaker assemblies, including marine foghorns and sirens.

2. Brief Description of Prior Art

It is known to augment the transmission of sound from a sound source, such as a loudspeaker driver, by establishing an acoustical transmission path from the outlet of the driver into the throat of a horn of some selected shape and size, through the horn and out of the mouth of the horn. The frequency response of the horn, that is, the performance of the horn as a function of the frequency of sound introduced into the horn, depends on the shape of the horn and its length. Additionally, the shape of the horn and its mouth determine the directional characteristics of the horn as a function of the sound frequency. Horns are selected to fit particular applications of the sounds being generated.

As an example, a horn in the form of an elongate cylindrical tube, or pipe, will propagate sounds for which the length of the pipe is equal to an odd number of quarter wavelengths. The frequency response of such a pipe horn features a relatively high amplitude spike at the frequency corresponding to the wavelength that is four times the length of the pipe, and is zero for lower frequencies. The pipe horn will transmit harmonics of the frequency at the spike, but at smaller amplitudes. A pipe horn is suitable for use in propagating sound of a single frequency, for example.

A horn that flares, that is, a horn featuring a cross section that increases with distance from the throat of the horn to its mouth, generally has a frequency response that goes to zero for sound frequencies below a cutoff frequency whose wavelength is equal to four times the length of the horn, but which tends to flatten for higher sound frequencies, that is, smaller wavelengths. A horn with a constant flare rate, such as an exponential horn whose cross-sectional area doubles for equal increments of length of the horn, tends to provide a broad, useful bandwidth beyond the cutoff frequency of the horn.

In general, the longest wavelength of sound for which a horn is an effective sound propagator is equal to four times the length of the horn, that is, four times the acoustical transmission path defined by the horn. For sound of shorter wavelengths, the effectiveness of the horn as a sound transmitter depends upon the shape of the horn, that is, upon the flare of the horn and the mouth of the horn. The directional characteristics of sound transmitted by a horn are determined by the mouth of the horn.

It is particularly important in the field of acoustical warning signals, such as produced by sirens and marine foghorns, that the sound be transmitted over long distances, although the frequencies of the sounds may be limited. Indeed, foghorns generally produce only one or two basic sound frequencies. Further, such warning signals may be concentrated in a selected range of directions. For example, a warning horn set to mark a hazard at sea need not direct sound vertically, and can in fact concentrate the sound propagation generally horizontally. Also, such a warning horn may limit the horizontal arc through which the sound is propagated, there being no need to direct sound on shore, for example. Finally, to maximize the effectiveness of a horn to transmit selected sounds produced by a sound driver the acoustical transmission path provided by the horn should be tuned to the wavelength of the sounds.

SUMMARY OF THE INVENTION

The present invention provides an acoustical horn for use with a sound generator, such as a loudspeaker driver, with the horn including surfaces defining an acoustical transmission path whose cross section is generally concentric about its central vertical axis. A generally planar segment of the acoustical path, that is, a segment in which the acoustical path may be considered to be centered along a horizontal plane, extends generally radially away from the central vertical axis, and is defined, at least in part, by opposing housing surfaces. At the radially outer edge of the planar segment of the acoustical path, the path continues in divides into two, generally longitudinal vertical segments in the form of first and second branches of the acoustical path whose curvatures are centered about the axis and which extend in opposite senses away from the planar segment of the path. The longitudinal path branches are defined by facing surfaces of first and second inner walls extending in opposite senses from the planar surfaces, and of an outer wall that is shorter than the combined length of the inner walls and the longitudinal distance between the planar surfaces. At the end of the first longitudinal branch of the path a first arcuate plate provides a first arcuate surface extending generally radially outwardly from the end of the first inner wall to cooperate with the end of the outer wall to define a first arcuate mouth of the acoustical path, directed radially outwardly; at the end of the second longitudinal branch of the path a second arcuate plate provides a second arcuate surface extending generally radially outwardly from the end of the second inner wall to cooperate with the opposite end of the outer wall to define a second arcuate mouth of the acoustical path, directed radially outwardly as well.

The lateral dimensions of the acoustical transmission path perpendicular to the direction of propagation along the path and in a plane containing the axis may be defined to increase incrementally, that is, by finite steps, in proceeding from one segment of the path to the next, as well as to increase in proceeding along a given segment of the path. The generally longitudinal branches of the acoustical path may each be, at least in part, slanted relative to the axis. The arcuate extent of the acoustical path of the horn about the axis may be 360° or less.

The present invention also provides an acoustical horn tuner, positioned to communicate generally with the planar segment of the acoustical path generally at the axis. The tuner includes a piston selectively movable in a cylinder, and a pipe connected to the piston toward one end of the pipe. The pipe is movable longitudinally with the piston relative to the cylinder. The tuner defines an acoustical transmission path segment that extends through the pipe from the end of the pipe distal from the piston to the end of the pipe toward the piston, out of the pipe between the end of the pipe and the piston and back along the interior of the cylinder external to the pipe for whatever extent the pipe is within the cylinder.

The present invention thus provides a folded acoustical horn that includes two parallel arcuate acoustical path mouths, directed radially outwardly and longitudinally spaced apart a selected distance. A horn tuner is operable for selectively adjusting the acoustical transmission path of the horn to match selected sound frequencies.

BRIEF DESCRIPTION OF THE DRAWINGS

FIG. 1 is a perspective view of a folded acoustical horn according to the present invention;

FIG. 2 is a top plan view of the horn shown in FIG. 1, illustrating the placement of a horn tuner according to the present invention;

FIG. 3 is a bottom plan view of the horn shown in FIGS. 1 and 2, illustrating the placement of a loudspeaker driver;

FIG. 5 is a top plan view of the path extender included in the horn tuner;

DESCRIPTION OF PREFERRED EMBODIMENTS

Figure 4:
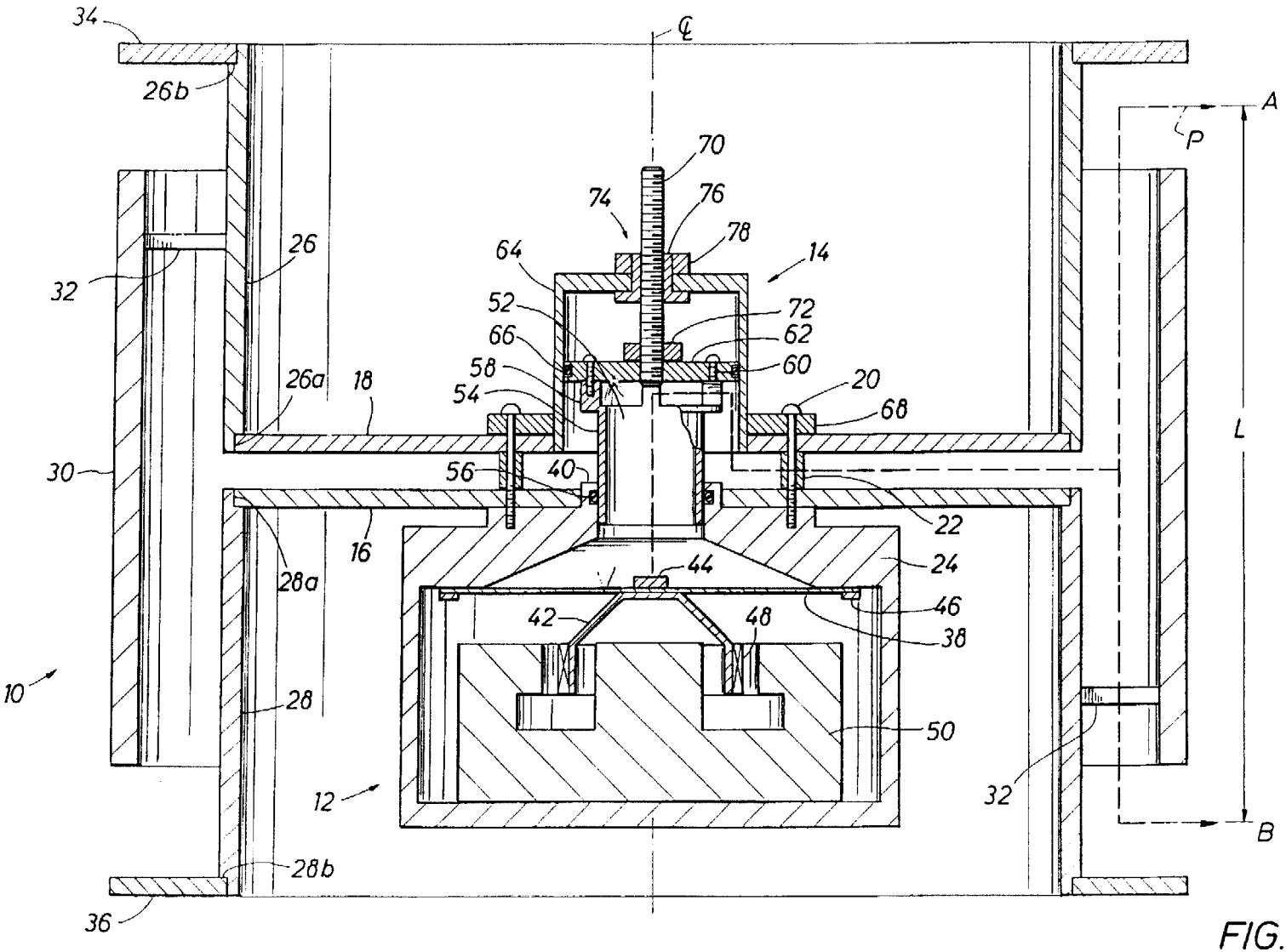
FIG. 4 is a side elevation in partial section, and partly schematic, of the horn and driver of FIGS. 1–3, illustrating details of the horn tuner and details of the folding of the horn.

A folded acoustical horn 10 according to the present invention is shown generally in FIGS. 1–4. The horn 10 features two cylindrical mouths A and B, longitudinally separated at their respective centers by a distance L as indicated in FIG. 4. The distance L is chosen to equal to one-quarter of the wavelength of a selected sound frequency, as discussed below. The horn mouths A and B various wall surfaces, described below, which fold and branch thereby forming an acoustical transmission path, indicated by the dashed line P in FIG. 4, which, at least in part, is generally considered cylindrically symmetric about the central vertical axis of the horn, indicated by the broken line CL in FIG. 4.

The folded horn 10 as seen FIG. 1 & 4 is defined by upper and lower tubular segments 9, 11, the lower tubular segment having one end open and one end closed by end plate 16 and the upper tubular segment having one end open and one end closed by end plate 18, both upper and lower tubular segments having external flanges 34, 36 located opposite the end plates 16, 18. The upper and lower tubular members 9,11, are oriented in a manner whereby the end plates 16, 18 are attached together and held apart, and concentric about a central vertical axis, by spacers 22.

A loudspeaker driver is shown generally at 12 in FIGS. 3 and 4 connected to the horn 10, and a horn tuning assembly is shown generally at 14 in FIGS. 2 and 4. The driver 12 is mounted on a circular wall, or plate, 16, and the tuner 14 is mounted on a circular wall, or plate, 18. The two plates 16 and 18 are mutually parallel, of equal outer diameter, and are concentric about the central axis CL. In particular, the two plates 16 and 18 are held together by eight bolts 20 (two are shown in FIG. 4) passing through appropriate holes in both plates and passing through spacers 22 between the plates, and threaded in appropriate bores in the top of a housing 24 as part of the driver 12. The generally cylindrical area between the inner surfaces of the plates 16 and 18, maintained by the spacers 22, defines a portion of the acoustical path P of the folded horn 10.

A first right, circular, cylindrical inner wall 26 of radius approximately equal to the radius of each of the two plates 16 and 18 is mounted on the outer end of the plate 18 by any appropriate means, such as by bonding with glue or other type of cement. The inner, bottom edge **26*a* of the wall 26 is flanged to receive the outer edge of the plate 16 to facilitate the bonding. A like second right, circular, cylindrical inner wall 28, with the same external radius as the wall 26, is similarly mounted on the outer end of the plate 18, utilizing a flange 28*a* at the inner, top edge of the wall 28 to receive the outer edge of the plate. Together the walls 26 and 28 define a right, circular, cylindrical surface broken by a uniform gap defined by the spacing between the plates 16 and 18**, and parallel to and concentric about the central axis CL.

A right, circular, cylindrical outer wall 30 surrounds the inner walls 26 and 28 and the ends of the plates 16 and 18, and is mounted a selected radial distance from the radially outer extent of the inner walls by a plurality of standoffs 32 (two are shown in FIG. 4). The standoffs 32 may be bonded to the components 26, 28 and 30, or alternatively a plurality of nuts and bolts, with appropriate spacers, similar to the components 20 and 22, may be used to mount the wall 30 on the walls 26 and 28. The outer wall 30 is thus parallel to and concentric about the central axis CL. The combination of the inner walls 26 and 28 and the outer wall 30 provides two right, circular, cylindrical branches of the acoustical path P extending in both opposite senses perpendicular to the segment of the acoustical path between the plates 16 and 18, and parallel to and concentric about the central axis CL. Thus, the acoustical path P is split at the intersection of the space between the plates 16 and 18 and the annular space defined by the exterior surfaces of the inner walls 26 and 28 and the interior surface of the outer wall 30.

A first annular ring wall 34 is mounted by bonding or other appropriate method on the upper end of the inner wall 26, and a second annular ring wall 36 is similarly mounted on the bottom end of the other inner wall 28, both tings being in a respective plane perpendicular to the central axis CL. The outer, top edge **26*b* of the wall 26 is ranged to receive the inner edge of the ring 34, and the outer, lower edge 28*b* of the wall 28 is ranged to receive the inner edge of the ring 36, to facilitate the mounting of the rings on the inner walls. Each of the rings 34 and 36 is perpendicular to and concentric about the central axis CL, and extends radially outwardly over the respective near end of the outer wall 30, whose length is shorter than the longitudinal extent of the combination of the two inner walls 26 and 28 and the gap between the two plates 16 and 18. Thus, the right, circular, cylindrical horn mouths A and B are provided at the opposite ends of the outer wall 30 by the combination of the ends of that wall and the rings 34 and 36**, respectively, longitudinally displaced the same longitudinal distance in each case from the respective proximal end of the outer wall. The longitudinal distance between the longitudinal center of the mouth A and the longitudinal center of the mouth B is the distance L as shown in FIG. 4 and as noted above.

The driver 12 may take any appropriate form, and may include a flat diaphragm or a spherical diaphragm, for example. For purposes of discussion and not to limit the present invention or its application, a driver 12 having a flat diaphragm 38 is illustrated, partly schematically, and described herein. The driver 12 is shown in FIG. 4 as received in an appropriate opening in the plate 18 with a neck 40 of the driver housing 24 extending a short distance into the space between the two plates 16 and 18. An armature 42 is fixed to the diaphragm 38 by a threaded assembly 44 permitting the adjustment of the weight thereof for tuning purposes. The edge of the diaphragm 38 is anchored to the housing 24 by an appropriate ring 46, for example. The armature 42 carries a coil 48 within a gap between generally circular pole ends of a permanent magnet 50. Leads from the coil 48 (not shown) extend to an external power source (not shown) which selectively generates electric current in the coil to cause the coil to oscillate longitudinally within the pole face gap of the magnet 50 at frequencies determined by the power source. Consequently, the armature 42 and the attached diaphragm 38 vibrate at the same selected frequencies to produce an acoustical wave of the selected frequency or frequencies to enter the acoustical transmission path P between the plates 16 and 18 by way of the tuning assembly 14.

The length of the acoustical path P is adjustable by use of the tuning device 14. As may be appreciated by reference to FIG. 4, the horn tuner 14 provides a cylindrical horn path extender 52 that is movable longitudinally along the central axis CL, and features an elongate neck, or pipe segment, 54 that so moves within the central opening in the driver housing 24. An O-ring 56 residing in an appropriate grove in the wall of the opening of the driver housing 24 provides a sliding seal between the extender neck 54 and the driver 12.

The top of the extender 52 as viewed in FIG. 4 includes four posts 58 having threaded bores for receiving bolts 60 by which the extender is connected to a sliding piston 62. FIG. 5 further illustrates details of the construction of the top of the extender 54. The piston 62 is movable along the central axis CL within a cylinder 64 of the tuner 14 that is parallel to and concentric about the central axis CL. An O-ring 66 residing in an appropriate groove in the outer, cylindrical surface of the piston 62 provides a sliding seal between the piston and the inner, cylindrical surface of the cylinder 64. The cylinder 64 is anchored to the plate 18 by the bolts 20 passing through holes in an annular flange 68 that is carded on the cylinder, as shown in FIGS. 2 and 4, by welding, for example.

The mechanism to selectively move and position the piston 62 in the cylinder 64 includes a bolt 70 received in a threaded bore in the piston and fixed there by a locking nut 72 tightened down on the bolt at the piston. The bolt 70 is thus fixed against rotation relative to the piston 62. A rotatable threaded collar shown generally at 74 extends through a hole in the top of the cylinder 64. The collar 74 is constructed using a threaded insert 76 to which a ring 78 is fixed so that the combination of the insert and the ring may rotate in the hole in the top of the cylinder 64, but not move longitudinally out of the hole. The bolt 70 is threaded through the insert 76. Rotation of the insert 76 by means of the ring 78 causes the bolt 70 to advance upwardly or downwardly, depending on the sense of the rotation of the insert, since the bolt is held against rotation by the piston 62, which experiences sufficient resistance to rotation by its sealing fit within the cylinder 64. As the bolt 70 is thus raised or lowered relative to the cylinder 64, the piston 62 and the attached extender 52 so move with the bolt. Thus, the pipe segment 54 is made to slide toward or away from the driver diaphragm 38.

The acoustical transmission path P of the horn 10 thus begins at the driver diaphragm 38 and continues along the pipe 54 of the extender 52 toward the proximal surface of the piston 62 where the path continues between the top end of the pipe segment and the bottom of the piston, and between the posts 58. The acoustical path P continues back down within the cylinder 64 and along the exterior of the extender pipe 54 to the space between the plates 16 and 18, radially along that space to the end thereof at the gap between the inner walls 26 and 28, longitudinally in either sense in the cylindrical space between the inner surface of the outer wall 30 and the outer surface of either inner wall 26 or 28, and radially outwardly between an end of the outer wall and the inner surface of either ring wall 34 or 36, that is, through the mouth A or B. The portion of the acoustical path P starting at the diaphragm 38 and passing through the interior of the pipe 54, and back down the exterior of the pipe within the cylinder 64 to the space between the plates 16 and 18 increases as the piston 62 is raised in the cylinder, and decreases as the piston is lowered in the cylinder. The length of the acoustical path P is thus able to be selectively increased or decreased by moving the piston 62, with the extender 52 attached thereto, longitudinally within the cylinder 64 by selected rotation of the collar 74 to so vary the length of the path P within the cylinder.

The longitudinal distance L between the longitudinal centers of the two arcuate mouths A and B is selected to be one-fourth of the wavelength of the basic sound desired to be transmitted by the horn 10. Then, sound emitted from the mouths A and B simultaneously and traveling parallel to the axis CL will destructively interfere. The result will be that sound emitted by the two mouths A and B of the horn 10 will be concentrated toward the horizontal, that is, in directions generally perpendicular to the axis CL. Then, to make the length of the acoustical path P an odd number of quarter wavelengths, P can be set at three-fourths of the wavelength of the selected sound frequency for which L is one-fourth the wavelength. Other combinations of values of L and P may be chosen to achieve destructive sound interference in directions parallel to the axis of a horn according to the present invention while maximizing the transmission of sound of a selected frequency by the horn. L is set at some odd number of quarter wavelengths of the selected sound frequency, and P is also set at some odd number of quarter wavelengths of the same sound frequency. For example, both L and P could set at one-fourth of the wavelength of the selected sound frequency.

While the acoustical transmission path P extends generally radially, between the circular plates 16 and 18, along the two longitudinal branches and then out of the two mouths A and B, the thickness, or cross section of the path in a plane containing the central axis of the horn may be varied to establish an additional flare. For example, the thickness, or cross section of the path P in a plane containing the central axis CL, as shown in FIG. 4, approximately doubles in proceeding from between the circular plates 16 and 18 to the longitudinal tubular space between the walls 26,28 and 30, and then exhibits a further increase upon entering the mouths A and B. The horn 10 of FIGS. 1–4 could be constructed with the same thickness, or cross section, to the acoustical transmission path extending between the circular plates 16 and 18 through to the mouths A and B. In such case, the frequency response would exhibit a low frequency cutoff adjacent a spike corresponding to a wavelength three times as long as the length of the path P, with a smaller response for higher frequencies. The spike effect is broadened, and the response generally increased for higher frequencies with the increasing cross section of the path P for increased distance along the path toward the mouths A and B. Consequently, structuring the acoustic path to feature an increased cross section transverse to the flare provided by the circumferential expansion of the horn due to its cylindrical construction broadens the usable frequency response of the horn.

Figure 8:
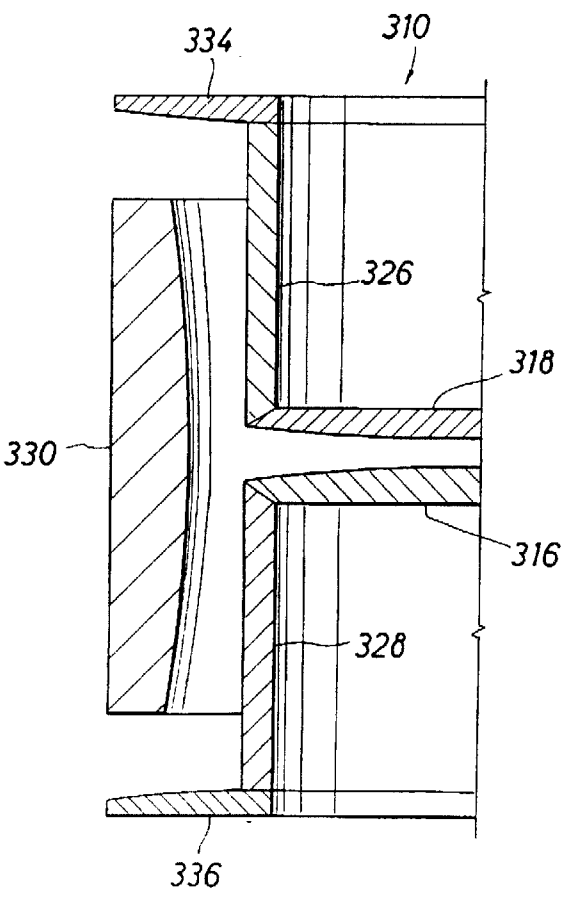
FIG. 8 is another view similar to FIGS. 6 and 7 of yet another version of a horn according to the present invention, showing curved surfaces to vary the flare of the horn.
Figure 7:
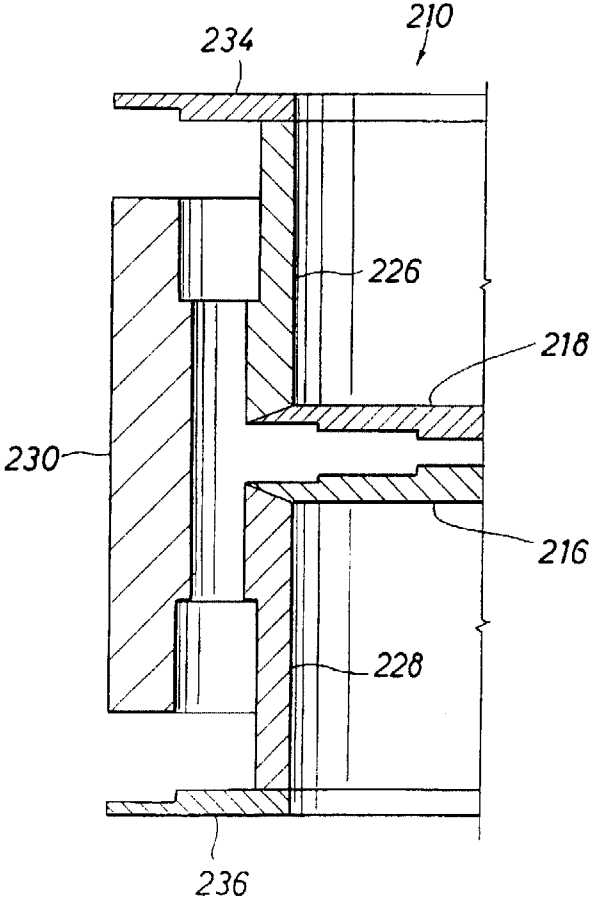
FIG. 7 is a view similar to FIG. 6 of another version of a horn according to the present invention, showing stepped surfaces for varying the flare of the horn.
Figure 6:
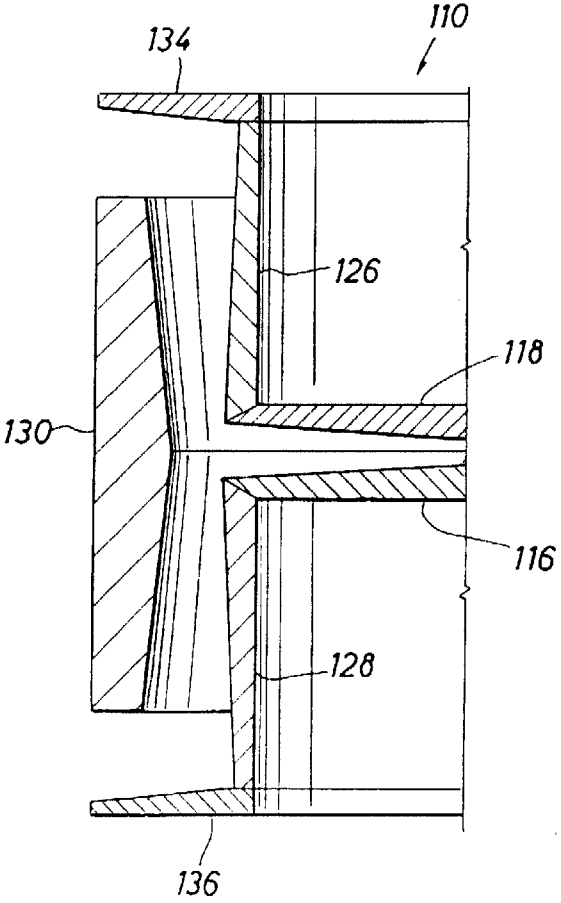
FIG. 6 is a schematic, fragmentary side elevation in cross section of another version of a horn according to the present invention, showing the use of conical surfaces to alter the effective flare of the horn.

FIGS. 6–8 show additional constructions of a folded acoustical horn for enhancing the frequency response of emitted sound according to the present invention. In each of these three cases, the cross section of the acoustical path perpendicular to the direction of sound propagation and in a plane containing the axis (not shown) about which the horn is arcuate increases incrementally as the path proceeds from the radial segment between generally circular plates to a generally longitudinal tubular segment, split between sets of generally cylindrical, tubular walls, and then increases incrementally again in proceeding into the two mouths of the horn. Additionally, the same cross section of the acoustical path in each case increases within each of the segments of the path.

A portion of a folded horn according to the present invention is shown generally at 110 in FIG. 6, wherein the acoustical path of the horn may begin at a driver and a horn tuner as in FIG. 4, for example. The acoustical path of the horn 110 then proceeds between plates 116 and 118 to a generally tubular spacing between generally cylindrical inner walls 126 and 128, and a generally cylindrical outer wall 130, where the path is split as in the case of the horn 10. Thereafter, the split path exits two arcuate mouths formed between the ends of the wall 130 and respective ring walls 134 and 136. The interior surface of each of the plates 116 and 118 facing the other such plate is conical, so that the distance between the two plates increases with increasing radius. At the outer edges of the plates 116 and 118 the cross section of the path features an incremental increase as the path continues into the space between the inner surface of the outer wall 130 and the outer surface of each of the inner walls 126 and 128, from the gap between the plates 116 and 118. The outer surface of the inner wall 126 is conical, and the outer surface of the inner wall 128 is also conical; further, the top half of the inner surface of the outer wall 130 is conical in one sense, and the bottom half of the same surface is conical on the opposite sense. Therefore, the radial distance between the inner wall 126 and the outer wall 130 increases with increased distance away from the gap between the plates 116 and 118, and the radial distance between the inner wall 128 and the outer wall 130 also increases with increased distance away from the gap between the plates 116 and 118. Consequently, the cross section of the acoustical path further increases as the path continues generally longitudinally in opposite senses away from the gap between the plates 116 and 118. Finally, as the acoustical path turns to enter the mouth at each end of the outer wall 130, the cross section of the path exhibits an incremental increase, followed by a continuous increase as the path traverses the distance radially along each ring wall 134 and 136 and out of the respective mouth due to the conical construction of the surfaces of the ring walls facing the ends of the outer wall to define the mouths.

A portion of another folded horn according to the present invention is shown generally at 210 in FIG. 7, wherein the acoustical path of the horn may again begin at a driver and a horn tuner as in FIG. 4, for example. The acoustical path of the horn 210 then proceeds between plates 216 and 218 to a generally cylindrical tubular spacing between generally cylindrical inner walls 226 and 228, and a generally cylindrical outer wall 230, where the path is split as in the case of the horn 10. Thereafter, the split path exits two arcuate mouths formed between the ends of the wall 230 and respective ring walls 234 and 236. The interior surface of each of the plates 216 and 218 facing the other such wall is radially stepped in three segments, so that the distance between the two plates increases incrementally with each step. At the outer edges of the plates 216 and 218 the cross section of the path features another incremental increase as the path continues into the space between the inner surface of the outer wall 230 and the outer surface of each of the inner walls 226 and 228, from the gap between the plates 216 and 218. The outer surface of the inner wall 226 is stepped one time, and the outer surface of the inner wall 228 is also stepped one time; further, the inner surface of the outer wall 230 is stepped opposite the step in the inner wall 226, and is also stepped opposite the step in the inner wall 228. Therefore, the radial distance between the inner wall 226 and the outer wall 230 increases incrementally with increased distance away from the gap between the plates 216 and 218, and the radial distance between the inner wall 228 and the outer wall 230 also increases incrementally with increased distance away from the gap between the plates 216 and 218. Consequently, the cross section of the acoustical path further increases incrementally as the path continues generally longitudinally in opposite senses away from the gap between the plates 216 and 218. Finally, as the acoustical path turns to enter the mouth at each end of the outer wall 230, the cross section of the path exhibits an incremental increase, followed by an incremental increase as the path traverses the distance along each ring wall 234 and 236 and out of the respective mouth due to a step in the surface of each of the ring walls facing the ends of the outer wall to define the mouths.

A portion of another folded horn according to the present invention is shown generally at 310 in FIG. 8, wherein the acoustical path of the horn may begin at a driver and a horn tuner as in FIG. 4, for example. The acoustical path of the horn 310 then proceeds between plates 316 and 318 to a generally tubular spacing between generally cylindrical inner walls 326 and 328, and a generally cylindrical outer wall 330, where the path is split as in the case of the horn 10. Thereafter, the split path exits two arcuate mouths formed between the ends of the wall 330 and respective ring walls 334 and 336. The interior surface of each of the plates 316 and 318 facing the other such plate is curved, so that the distance between the two plates increases with increasing radius. At the outer edges of the plates 316 and 318 the cross section of the path features an incremental increase as the path continues into the space between the inner surface of the outer wall 330 and the outer surface of each of the inner walls 326 and 328, from the gap between the plates 316 and 318. The top half of the inner surface of the outer wall 330 is curved outwardly in one sense, and the bottom half of the same surface is curved outwardly in the opposite sense, while the outer surfaces of the inner walls 326 and 328 each form right, circular cylinders. Therefore, the radial distance between the inner wall 326 and the outer wall 330 increases with increased distance away from the gap between the plates 316 and 318, and the radial distance between the inner wall 328 and the outer wall 330 also increases with increased distance away from the gap between the plates 316 and 318. Consequently, the cross section of the acoustical path further increases as the path continues generally longitudinally in opposite senses away from the gap between the plates 316 and 318. Finally, as the acoustical path turns to enter the mouth at each end of the outer wall 330, the cross section of the path exhibits an incremental increase, followed by a continuous increase as the path traverses the distance along each ring wall 334 and 336 and out of the respective mouth due to the outwardly curved construction of the surfaces of the ring walls facing the ends of the outer wall to define the mouths.

Based on the disclosure of the invention herein, it will be appreciated that variations of the surfaces defining the acoustical transmission path of a folded horn may be provided according to the present invention to extend the effective and useful frequency response of the horn by providing increased cross section to the path as the path proceeds toward the mouths of the horn. Additionally, the segments of the acoustical path may be varied in their direction according to the present invention, for example.

Figure 9:
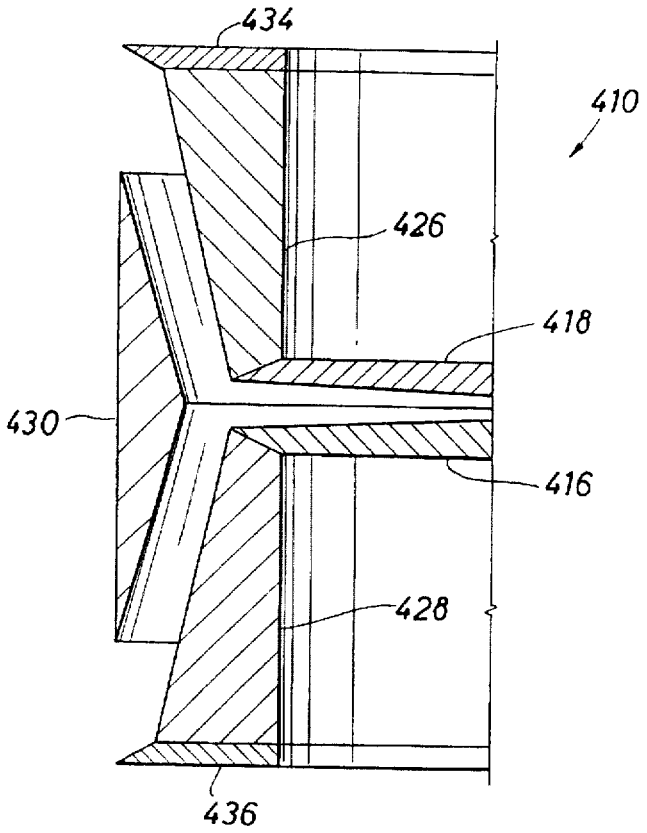
FIG. 9 is another view similar to FIGS. 6–8 of still another version of a horn according to the present invention, showing another use of conical surfaces to direct the acoustical transmission path of the horn.

FIG. 9 illustrates a portion of another folded horn according to the present invention, shown generally at 410, wherein the acoustical path of the horn may begin at a driver and a horn tuner as in FIG. 4, for example. The acoustical path of the horn 410 then proceeds between plates 416 and 418 to a generally tubular spacing between inner walls 426 and 428, and a generally cylindrical outer wall 430, where the path is split as in the case of the horn 10. Thereafter, the split path exits two arcuate mouths formed between the ends of the wall 430 and respective ring walls 434 and 436. The interior surface of each of the plates 416 and 418 facing the other such plate is conical, so that the distance between the two plates increases with increasing radius. At the outer edges of the plates 416 and 418 the cross section of the path features an incremental increase as the path continues into the space between the inner surface of the outer wall 430 and the outer surface of each of the inner walls 426 and 428, from the gap between the plates 416 and 418. The outer surface of the inner wall 426 is conical, extending radially outwardly as distance from the plate 418 increases; similarly, the outer surface of the inner wall 428 is conical, extending radially outwardly as distance from the plate 416 increases. The top half of the inner surface of the outer wall 430 is conical in one sense, and the bottom half of the same surface is conical in the opposite sense. The net effect is that the radial distance between the inner wall 426 and the outer wall 430 increases with increased distance away from the gap between the plates 416 and 418, and the radial distance between the inner wall 428 and the outer wall 430 also increases with increased distance away from the gap between the plates 416 and 418. Consequently, the cross section of the acoustical path further increases as the path continues generally longitudinally in opposite senses away from the gap between the plates 416 and 418. At the same time, the acoustical path is directed radially outwardly as the path proceeds longitudinally away from the gap between the plates 416 and 418 due to the cooperation between the surfaces 430 and 426, and 430 and 428. Finally, as the acoustical path turns to enter the mouth at each end of the outer wall 430, the cross section of the path exhibits an incremental increase, followed by a continuous increase as the path traverses the distance along each ring wall 434 and 436 and out of the respective mouth due to the conical construction of the surfaces of the ring walls facing the ends of the outer wall to define the mouths.

A folded horn according to the present invention as illustrated in FIG. 9 features an acoustical transmission path that is directed both longitudinally and radially outwardly in the split segments between the outer wall 430 in the two inner walls 426 and 428. With such construction the length of the acoustical transmission path may be varied for a given longitudinal size and a given radial size of the horn.

As noted above, the sound transmitted by a cylindrically symmetric horn according to the present invention, as shown in FIGS. 1–4, for example, is directed in all directions perpendicular to the central axis CL of such a horn, that is, the arcuate extent of the acoustical transmission path about the axis is 360°. In some applications, the sound transmission from a single horn is to be concentrated in a directional beam that extends for less than a complete circle around the axis of the horn, for example. A folded horn according to the present invention may be constructed to so concentrate the sound transmission.

Figure 10:
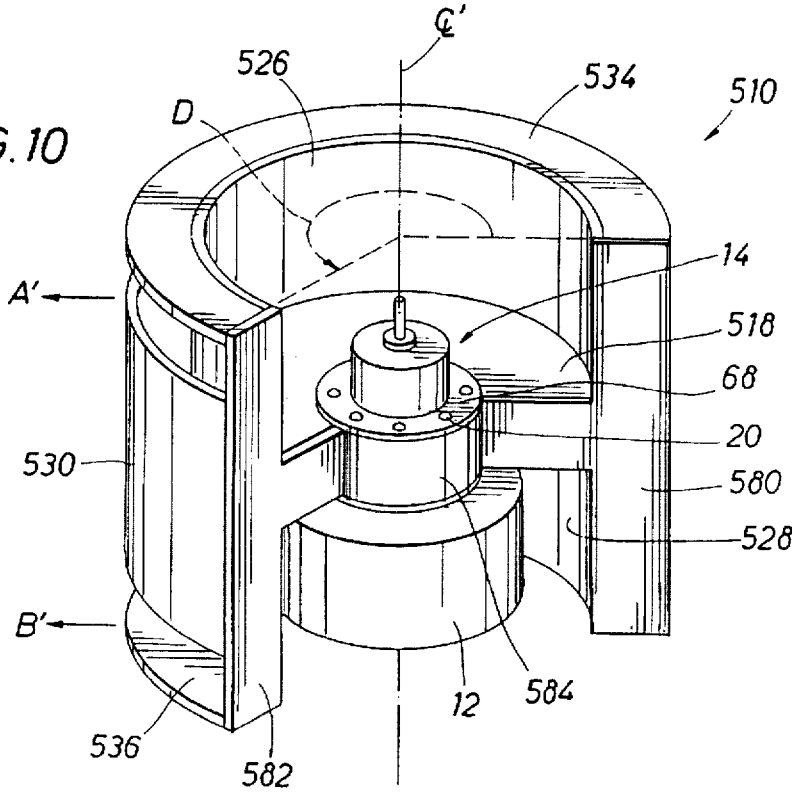
FIG. 10 is a perspective view similar to FIG. 1, but showing a folded horn for directing acoustical transmission in less than a 360° arc according to the present invention.

A folded horn according to the present invention constructed to concentrate sound transmission in a selected arc about an axis less than 360° is shown generally at 510 in FIG. 10. The particular embodiment illustrated in FIG. 10 is a variation of the horn 10 of FIGS. 1–5, but could be constructed as a variation of any of the horns illustrated in FIGS. 6–9, for example. The horn 510 in FIG. 10 is shown fitted with a driver 12 and a horn tuner 14 as in the case of the horn 10 of FIGS. 1–5. The acoustic transmission path of the horn 510 is fine-tuned by the tuner 14 as described above, and then passes in the space between two generally parallel, mutually displaced, plates (only one 518 is visible) wherein the sound radiates radially outwardly. However, the plates are not circular, but rather extend about a longitudinal axis CL' of the horn through an arc, indicated by the arrow D, that is less than a complete circle. The acoustical transmission path of the horn 510 is split and passes longitudinally in the spaces between inner walls 526 and 528, and an outer wall 530, to two mouths A' and B' defined, in part, by the ends of the outer wall and two caps, or partial-ring walls, 534 and 536.

All of the walls 526, 528, 530, 534 and 536 extend in the arc D coincidental to the arcuate extension of the two plates. At the ends of the walls and of the plates defining the arc D the spaces therebetween containing the acoustical path are closed by T-shaped flat walls 580 and 582, while the space between the plates, and between the driver 12 and the tuner 14, is closed by a curved wall 584. The bolts 20 that hold together the driver 12, the tuner 14 and the two plates also pass through appropriate holes in the curved wall 584 to hold that wall in place as well. The curved wall 584 generally extends through an arc that is D less than a full circle. Thus, the walls 580, 582 and 584 combine with the plates and the walls 526–536 to define the acoustical transmission path of the horn 510 to concentrate the projection of sound radially from the horn mouths A' and B' about the arc D.

The value of the arc D is chosen for the specific application of the folded horn. Where the horn is to be mounted on a wall, for example, D may be set at 180° so that the horn projects sound in a semicircle. If the horn is to be placed on the corner of a structure, such as a drilling platform, with a like horn on each of the other corners, for example, D may be a selected from 90° to 270°, for example. Any value for D may be chosen up to 360° to fit the specific application of the horn according to the present invention.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A marine horn comprising:

a) a first elongated cup member having a base, an annulus and a flange surrounding said annulus;

b) a second elongated cup member located adjacent said first elongated cup member mirroring said first cup member and defining a space between said first and second cup base;

c) a sleeve member surrounding said first and second cup members, held in concentric alignment by pins attached to said first and second cup members thereby defining a space between said cup members, said sleeve members and each said flange;

d) an acoustical driver mounted inside second cup member, said driver having a throat in communication with said space between said first and second cups; and e) a mechanical tuning means mounted inside said first cup member, a portion of which extends into said throat for varying the pitch of said acoustical driver.

2. A marine horn according to claim 1 wherein said mechanical tuning means comprises:

a) a tubular housing having an endplate at one end and an external annular flange at another end opposite said endplate;

b) a piston slidable within said tubular housing;

c) a threaded stem attached to said piston threadably engaged with a collar attached to said endplate; and d) an extender sleeve attached to said piston via threaded post.

3. A marine horn according to claim 2 wherein said space between said first and second elongated cup members is maintained by a plurality of tubular sleeves held in position by a plurality of screws securing said mechanical tuning means to said first and second cup member.

4. A marine horn according to claim 3 wherein said tuning assembly further comprises a sealing means peripherally attached to said piston for isolating said piston from said tubular housing and a seal surrounding said throat in said second elongated cup member in a manner whereby said extender sleeve is isolated from and slidable through said second elongated cup member.

5. A marine horn according to claim 4 wherein said space between said first and second elongated cup members and said sleeve member define a radial sound path extending outwards from said acoustical driver, through said mechanical tuning means, to an opening at each end of said sleeve member.

6. A marine horn according to claim 5 wherein said sound path is divided by said sleeve member.

7. A marine horn according to claim 6 wherein said first and second cup bases have convex opposing faces.

8. A marine horn according to claim 6 wherein said first and second cup bases have stepped opposing faces.

9. A marine horn according to claim 6 wherein said sleeve member comprises an arcuate inner wall thereby producing an expanding opening between said inner wall and said first and second elongated cup members.

10. A marine horn according to claim 1 wherein said flange further comprises a beveled face.

11. A marine horn according to claim 1 wherein said flange and said sleeve member define a continuous radial opening around said first and second elongated cups members.

12. A marine horn according to claim 1 wherein said first and second elongated cup members including said flanges and said sleeve member are not continuous and comprise petitions.

13. A method of sound transmission and frequency adjustment via a folded marine horn comprising the steps of:

a) providing a folded horn for use in a marine environment comprising:

(i) a first elongated cup member having a base, an annulus and a flange surrounding said annulus;

(ii) a second elongated cup member located adjacent said first elongated cup member mirroring said first cup member and defining a space between said first and second cup base;

(iii) a sleeve member surrounding said first and second cup members, held in concentric alignment by pins attached to said first and second cup members thereby defining a space between said cup members, said sleeve members and each said flange;

(iv) an acoustical driver mounted inside second cup member, said driver having a throat in communication with said space between said first and second cups; and (v) a mechanical tuning means mounted inside said first cup member, a portion of which extends into said throat for varying the pitch of said acoustical driver;

b) emitting a selected sound frequency, emanating from said acoustic driver, radially via said space between said cup members, said sleeve members and each said flange; and adjusting said tuning means to a selected sound frequencies by mechanically changing length of said throat.

14. A method according to claim 13 wherein said sound transmission is emitted from said horn in an arch.

15. A method according to claim 13 wherein said sound transmission is radially emitted outwardly from mouths formed by said sleeve member and said flange surrounding said cup annulus.

* * * * *